US008341886B2

(12) United States Patent
Yates

(10) Patent No.: US 8,341,886 B2
(45) Date of Patent: Jan. 1, 2013

(54) GATE ASSEMBLY

(75) Inventor: Adam Yates, Harrogate (GB)

(73) Assignee: Munchkin, Inc., North Hills, CA (US)

( * ) Notice: Subject to any disclaimer, the term of this patent is extended or adjusted under 35 U.S.C. 154(b) by 1200 days.

(21) Appl. No.: 12/170,724

(22) Filed: Jul. 10, 2008

(65) Prior Publication Data

US 2009/0013604 A1 Jan. 15, 2009

(30) Foreign Application Priority Data

Jul. 12, 2007 (GB) ..... 0713455.4

(51) Int. Cl.
*E06B 7/00* (2006.01)
*E06B 9/01* (2006.01)

(52) U.S. Cl. ..... 49/55; 49/50; 49/56; 49/57; 49/61; 49/63; 49/67; 49/463; 422/64; 378/177; 204/468

(58) Field of Classification Search ..... 49/50, 55
See application file for complete search history.

(56) References Cited

U.S. PATENT DOCUMENTS

| | | | | |
|---|---|---|---|---|
| 5,396,732 | A * | 3/1995 | Andersen | 49/55 |
| 6,308,462 | B1 * | 10/2001 | Andersen | 49/57 |
| 6,347,483 | B1 * | 2/2002 | Andersen | 49/57 |
| 6,370,823 | B1 * | 4/2002 | Andersen | 49/57 |
| 6,536,163 | B1 * | 3/2003 | Monahan et al. | 49/465 |
| 6,655,087 | B2 * | 12/2003 | Andersen | 49/55 |
| 6,715,182 | B2 | 4/2004 | Cheng | |
| 7,131,235 | B2 * | 11/2006 | Hicks | 49/55 |
| 7,152,372 | B2 * | 12/2006 | Cheng | 49/465 |
| 7,373,755 | B2 * | 5/2008 | Jefferys et al. | 49/55 |
| 7,540,046 | B1 * | 6/2009 | Lai | 5/100 |
| 7,627,985 | B2 * | 12/2009 | Marsden et al. | 49/50 |
| 7,874,103 | B2 * | 1/2011 | Yates | 49/57 |
| 7,963,575 | B2 * | 6/2011 | Mayo et al. | 292/169 |
| 2004/0045222 | A1 * | 3/2004 | Hicks | 49/394 |

FOREIGN PATENT DOCUMENTS

| | | |
|---|---|---|
| DE | 20211469 | 10/2002 |
| EP | 2050906 B1 | 6/2011 |
| GB | 188101 A | 8/1921 |

* cited by examiner

*Primary Examiner* — Katherine W Mitchell
*Assistant Examiner* — Clarence W Mayott, III
(74) *Attorney, Agent, or Firm* — Robert Z. Evora, Esq.

(57) ABSTRACT

A gate assembly is provided including frame means for positioning in an opening through which selective entry is required. Barrier means are mountable on the frame means via hinge means and the barrier means are movable relative to the frame means between a closed position, wherein the opening is closed, to an open position, wherein the opening is open. An automatic closure mechanism is provided for moving the barrier means from the open position to the closed position without user intervention. The automatic closure mechanism is associated with the hinge means and includes at least one ramp or inclined surface on which at least part of the gate travels when moving between the open and closed positions.

19 Claims, 7 Drawing Sheets

GATE ASSEMBLY

This invention relates to a gate assembly, and particularly to a self closing gate assembly.

Although the following description refers almost exclusively to a self closing mechanism for a gate assembly in the form of a child safety barrier, it will be appreciated by persons skilled in the art that the self closing mechanism can be applied to any gate or barrier assembly.

It is known to provide child safety barriers which are removably located in an opening of a doorway, stairway and/or the like to prevent a child or animal from going through the opening when the barrier is in a closed position. The barriers typically include a frame which is fitted to side walls defining the opening, and a gate or barrier which is hingedly or slidably mounted to the frame for movement between open and closed positions. A problem with such child safety barriers is that a user can accidentally leave the barrier open, thereby allowing the child or animal to pass through the opening unsupervised.

In order to overcome the abovementioned problem, it is known to provide automatic closure mechanisms for gates, such that as soon as a user releases their grip on the gate, the gate automatically moves from an open position to a closed position. For example some automatic gate closure mechanisms include sprung hinges. The automatic closure mechanisms have to be designed so that a small child or animal cannot accidentally trap a body part therein as the gate moves to the closed position.

It is an aim of the present invention to provide a gate assembly with an improved automatic closure mechanism.

It is a further aim of the present invention to provide a method of using a gate assembly having an improved automatic closure mechanism.

It is a yet further aim of the present invention to provide an automatic closure mechanism for a gate assembly.

According to a first aspect of the present invention there is provided gate assembly, said gate assembly including frame means for positioning in an opening through which selective entry is required, barrier means mountable on said frame means via hinge means and said barrier means movable relative to said frame means between a closed position, wherein the opening is closed, to an open position, wherein the opening is open, and wherein an automatic closure mechanism is provided for moving the barrier means from the open position to the closed position without user intervention, characterised in that the automatic closure mechanism is associated with the hinge means and includes at least one ramp or inclined surface on which at least part of the gate travels when moving between the open and closed positions.

Thus, the present invention allows for automatic closing of a gate assembly without user intervention, thereby preventing the gate being accidentally left open.

The frame means is typically positioned in an opening defining a doorway, passageway, at the top or bottom of a set of stairs and/or the like. An outer surface of the frame means typically engages with wall surfaces defining the opening.

Positioning means can be provided on or associated with the outer surface of the frame means to allow the frame means to engage with wall surfaces defining the opening. The positioning means can include one or more friction pads and/or the like. The positioning means can be adjustable to allow the width of the gate assembly to change to accommodate different sizes of openings in which the gate assembly is located in use.

Preferably the barrier means includes at least upper or top hinge means and lower or base hinge means for mounting the barrier means to the frame means. Further preferably the ramp or inclined surface is associated with the lower or base hinge means.

In one embodiment the closure mechanism includes at least one inclined surface or ramp on or relative to which a part of the base of the barrier means moves in use. The inclined surface or ramp preferably has a first end closest to or adjacent to the side wall with which the gate assembly is fitted to in use or an upright frame member to which the barrier means is joined, and a second end provided furthest from or a spaced distance said side wall or said upright frame member. The second end is lower in vertical height than the first end. Thus, the ramp or inclined surface slopes downwardly in a direction towards a base frame member from the direction of a side wall or top frame member.

Preferably the base of the barrier means moves in a downwardly direction on the ramp or inclined surface (i.e. towards a narrowing taper of the ramp or inclined surface) as the barrier means rotates/pivots about said hinge means towards a closed position. The base of the barrier means moves in an upwardly direction on the ramp or inclined surface (i.e. towards a widening taper of the ramp or inclined surface) as the barrier means rotates/pivots about said hinge means towards an open position.

Preferably the closure mechanism includes a recess or aperture which at least part of the base of the barrier means drops into just prior to reaching the closed position. The recess or aperture is preferably located at the end of or adjacent the ramp or inclined surface.

Thus, in a preferred embodiment, the base of the barrier means moves relative to the inclined surface or ramp under gravity or a biasing force prior to dropping into the recess or aperture when moving from an open position to a closed position. The base of the barrier means undertakes the movements in reverse when moving from a closed position to an open position.

Preferably a user is required to lift the barrier means in an upwardly direction to move the base of the barrier means out of the recess or aperture and onto the ramp or inclined surface when moving the barrier means from a closed position to an open position.

In a preferred embodiment two ramp or inclined surfaces are provided on either side of the recess or aperture. As such, the barrier means can be opened and closed in either a forwardly or rearwardly direction and the automatic closure mechanism will still function.

The one or more ramps or inclined surfaces are typically defined on an upper surface of a housing and the recess or aperture is defined between the ramps or inclined surfaces in the housing. The two ramps or inclined surface are typically symmetrical and substantially parallel to each other.

Resilient biasing means are typically associated with the hinge means and said resilient biasing means biases the barrier means to the closed position. A user has to manually overcome the biasing force of the biasing means to move the barrier means to an open position. This may require the user to lift the barrier means. The biasing means can include a spring in one example.

Preferably the hinge means includes a hinge pin on one of the barrier means or frame means which is locatable in an aperture, slot or recess in the other of the barrier means or frame means in use, the hinge pin rotatable in said aperture, slot or recess to allow rotation of the hinge means. This in turn allows pivoting of the barrier means between open and closed positions.

Preferably the hinge means including the resilient biasing means is provided in at least the bottom hinge adjacent or forming part of the automatic closing mechanism.

The barrier means typically has hinge means arranged on a first side or lateral end or edge and latching means for latching the barrier means are arranged on a second or opposite lateral or side edge or end. The barrier latching means engages with latching means on the frame means or surrounding wall surface to lock the barrier means in the closed position. The automatic closure mechanism aligns the latching means on the frame means and barrier means to allow correct latching.

Preferably when the base of the barrier means is substantially aligned with the recess or aperture of the closure mechanism, the barrier latching means is substantially vertically aligned with the frame latching means. As the barrier means drops into the recess, the barrier latching means is lowered into engagement with the frame latching means.

In use, a user releases the latching mechanism and lifts the barrier means to remove the base of the barrier means from the recess of the closure mechanism, thereby opening the gate.

Preferably release of the latch mechanism and lifting action can be undertaken by a single user's hand, thereby freeing up the user's other hand for holding one or more objects, such as a baby and/or the like.

Preferably the latching mechanism is located on or adjacent an upper part of the barrier means or frame means. The position of the latching mechanism on the gate assembly and the lifting force required to lift the barrier means from the recess of the closure mechanism is such that a young child or animal are unlikely to be able to perform the opening actuation steps, thereby preventing a child from accidentally gaining passage through the gate assembly without adult supervision.

When the barrier means is in an unlatched position, it can be rotated about a substantially vertical axis via the hinge means.

The barrier means can include one or more gate panels. If more than one gate panel is used, said gate panels can be moved relative to each other, such as for example to allow the width of the barrier means to be adjusted.

According to a second aspect of the present invention there is provided a method of using a gate assembly.

In one embodiment of the method, said method includes the steps of positioning frame means in an opening through which selective entry is required, mounting barrier means on said frame means via hinge means and moving said barrier means relative to said frame means between a closed position, wherein the opening is closed, to an open position, wherein the opening is open, and wherein an automatic closure mechanism is provided for moving the barrier means from the open position to the closed position without user intervention, the automatic closure mechanism associated with the hinge means and including at least one ramp or inclined surface on which at least part of the gate travels when moving between the open and closed positions.

According to a further aspect of the present invention there is provided an automatic closure mechanism for a gate assembly.

Preferably the gate assembly is in the form of a child safety gate. The gate is typically in a form to allow detachable attachment within an opening of a building to which selective passage to is required.

In one embodiment indicator means, such as for example audible, visual and/or kinaesthetic means are associated with the barrier means to allow a user to be informed of whether the gate assembly is correctly fitted, whether the barrier means has not closed properly and/or the like.

In one embodiment limiting means are provided on or associated with the upper hinge means to limit vertical movement of a hinge pin in a hinge channel or recess. The limiting means in one example includes inter-engaging members, such as a flange provided on one of the hinge pin or hinge channel which engages with a shoulder arrangement provided on the other of the hinge pin or hinge channel, and/or the like.

In one embodiment the latching means includes a latch element which is slidably movable relative to a recess defined in a keep housing between a latched position, wherein the latch element is located in the recess of the keep housing and the gate is closed, to an unlatched position, wherein the latch element is located a spaced distance from the recess of the keep housing and the gate can be opened.

Preferably the latch element is resiliently biased to the latched position. The resiliently biasing means in one example can be a spring. Further preferably the biasing means are arranged to provide a biasing force in a substantially horizontal direction.

The advantage of the present invention is that accurate alignment of the latching mechanism is achieved on automatic closing of the gate assembly to ensure correct latching takes place.

Embodiments of the present invention will now be described with reference to the following figures.

Figure 1:
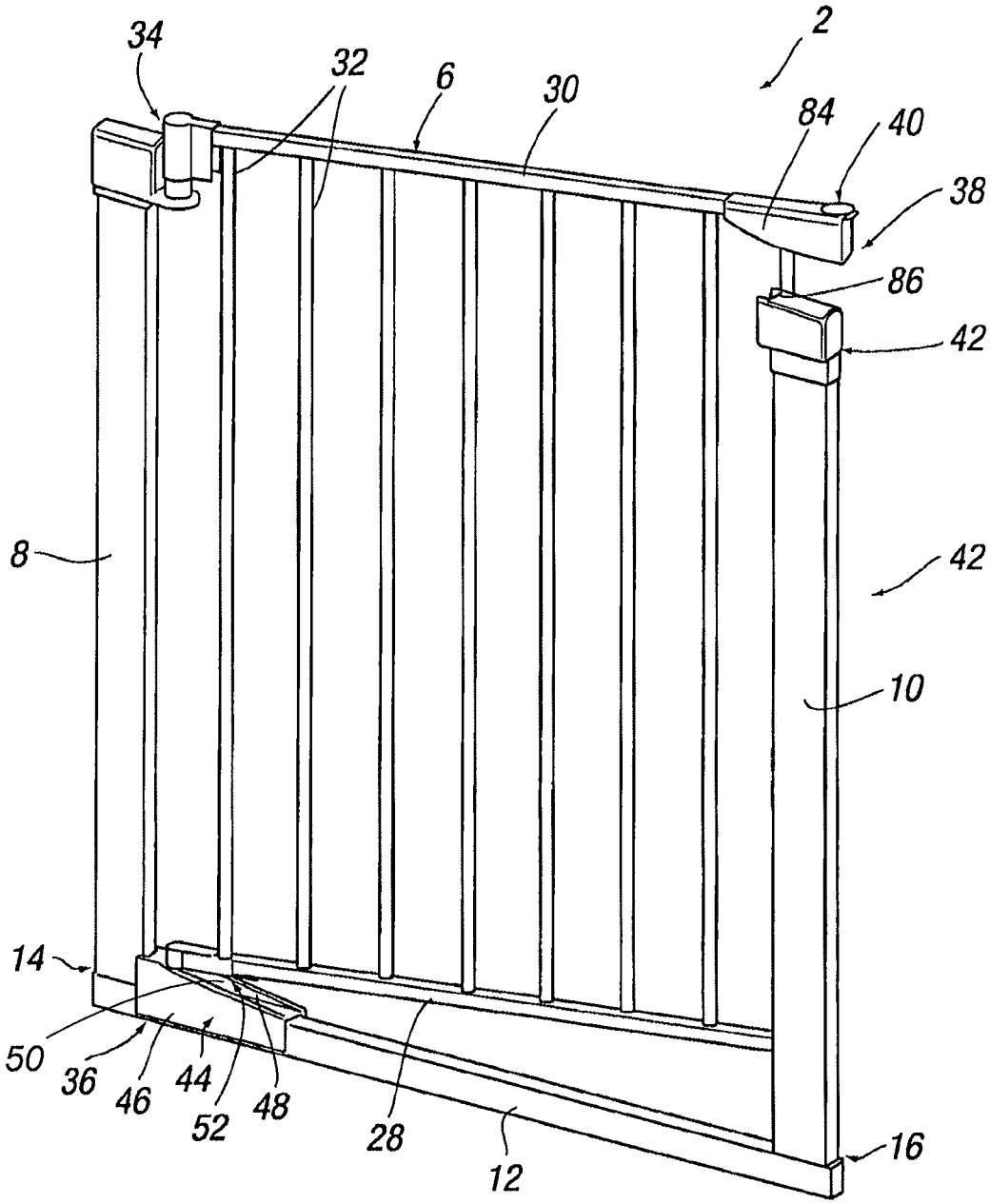
FIG. 1 is a perspective view of a gate assembly according to one embodiment of the present invention in an open position.
Figure 2:
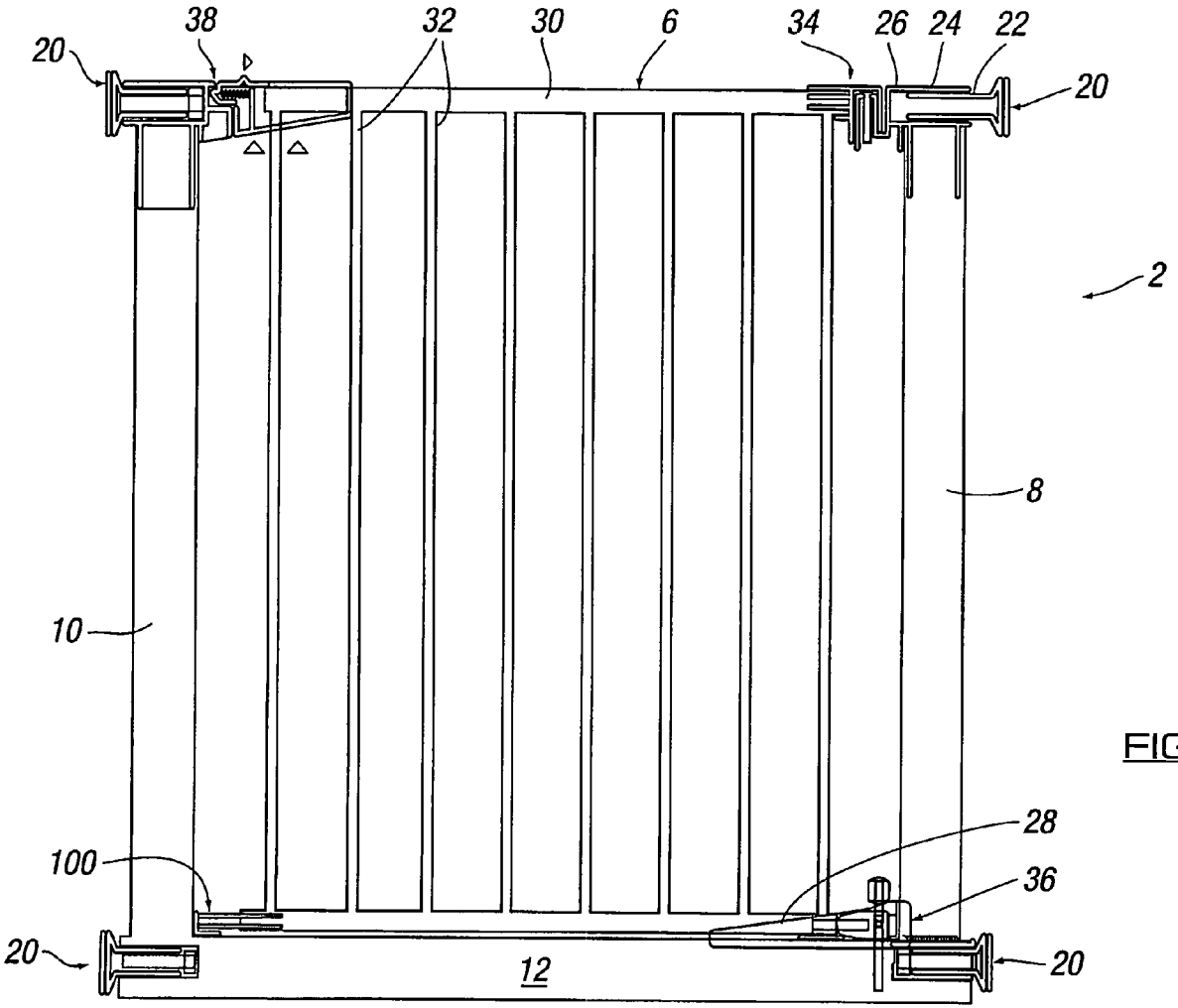
FIG. 2 is a front view of the gate assembly in FIG. 1 in a closed position with the latch mechanism and hinge mechanism shown in cross section.
Figure 4A:
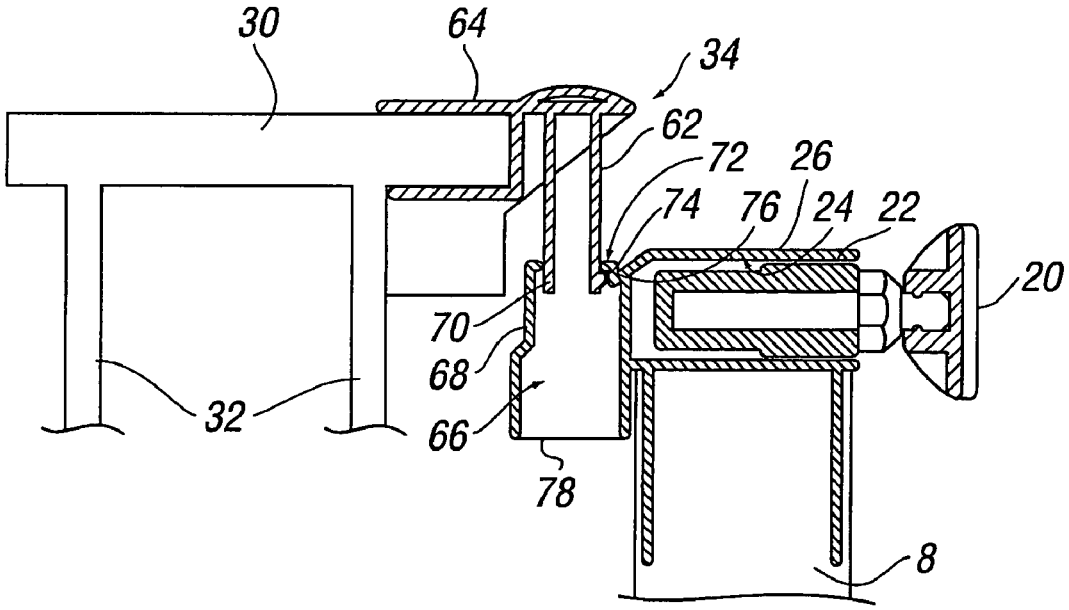
Figure 4B:
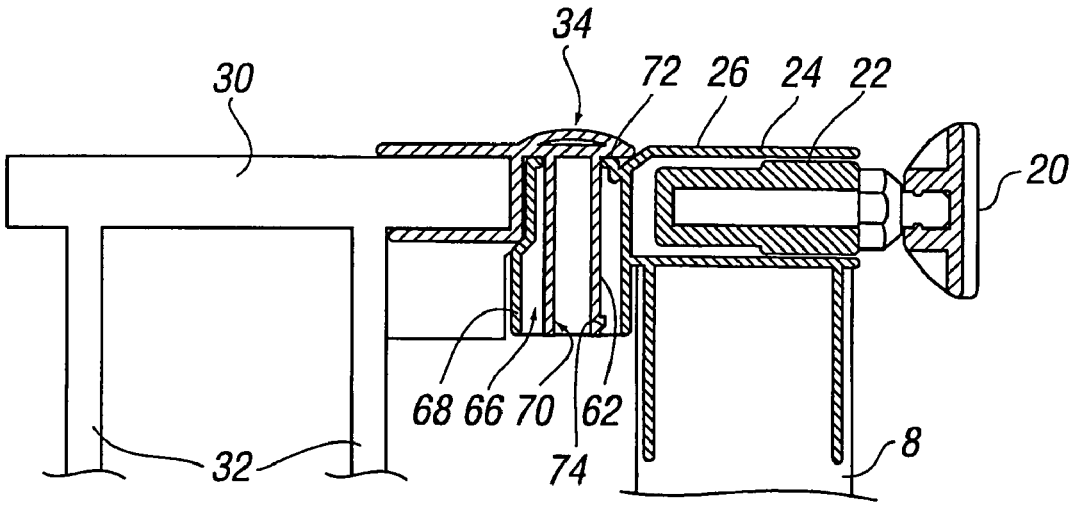
Figure 5A:
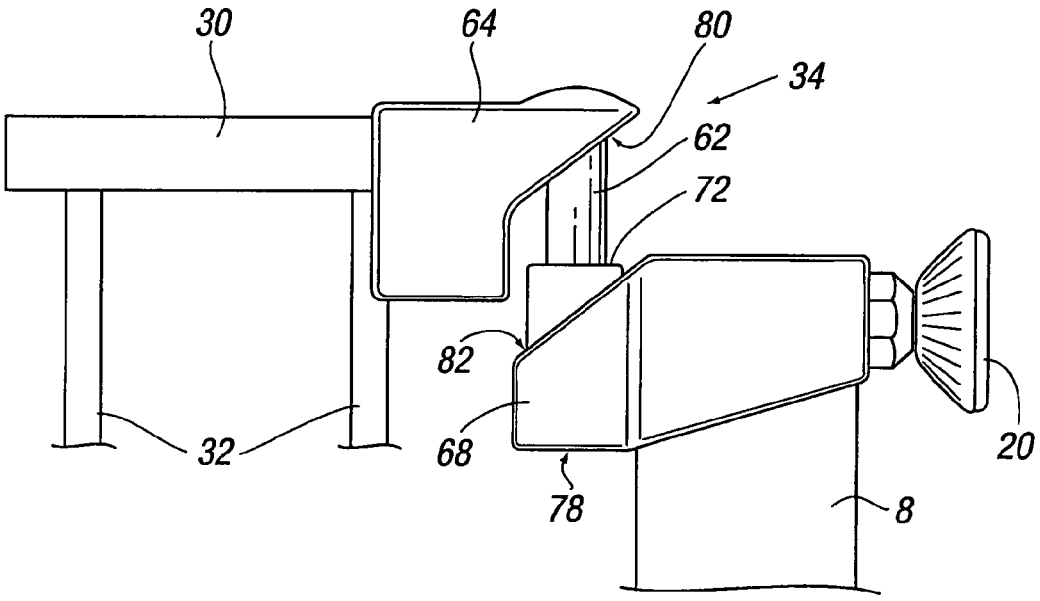
Figure 5B:
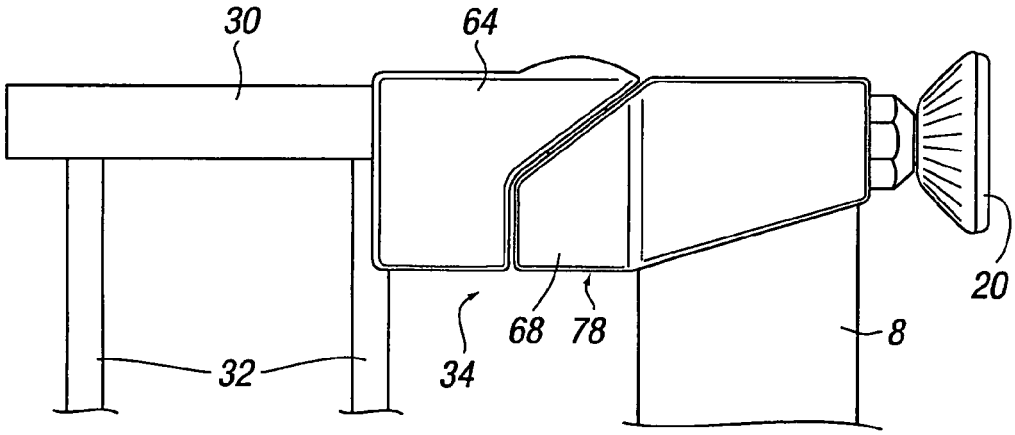
Figure 6:
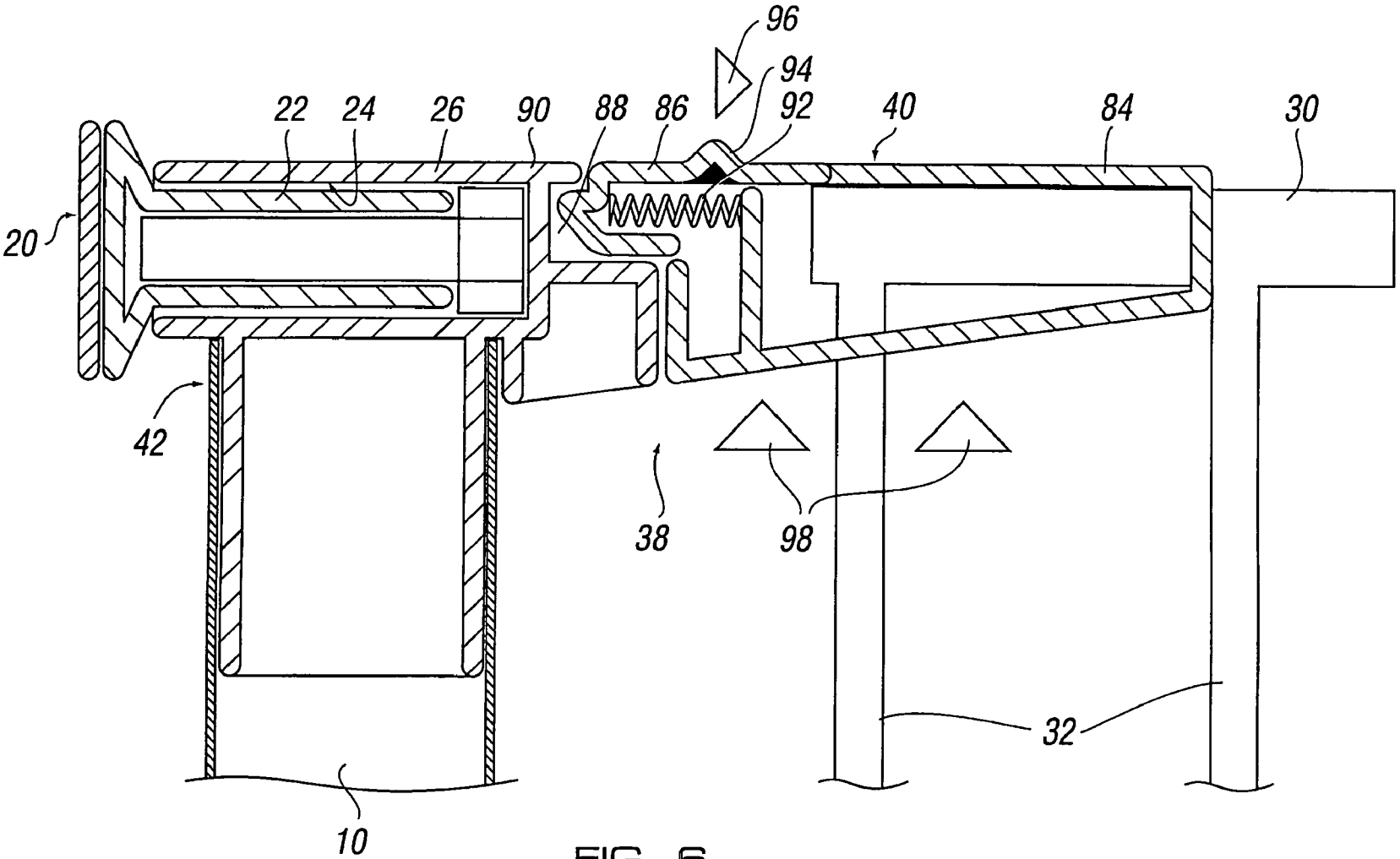
Figure 7:
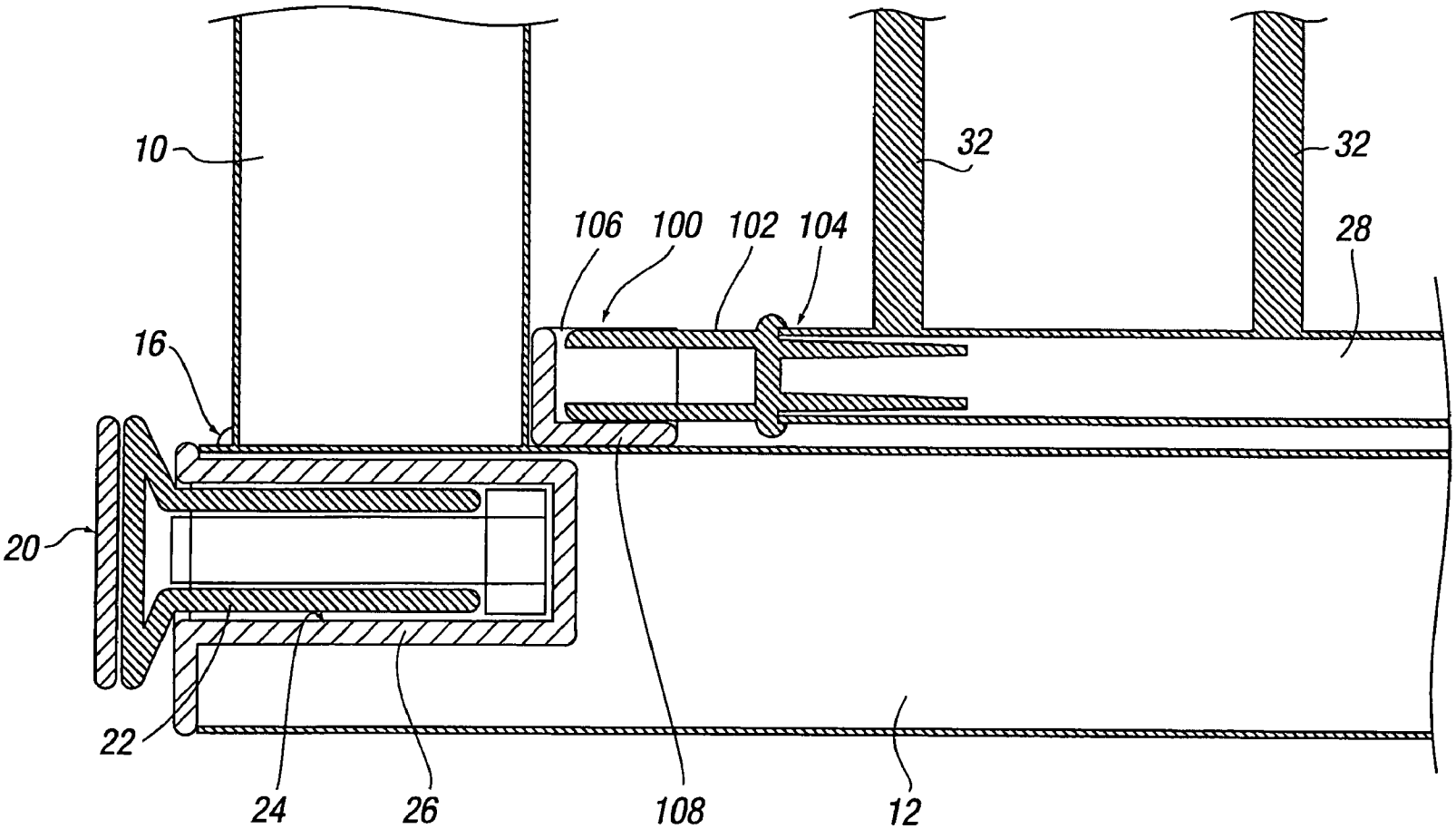

FIGS. 4*a*-4*b* show enlarged cross sectional views of the hinge means shown in FIG. 2 in an open and closed position respectively;

FIGS. 5*a*-5*b* show an outer view of the hinge means in FIGS. 4*a* and 4*b* respectively;

FIG. 6 is an enlarged cross sectional view of the upper latch mechanism shown in FIG. 2;

FIG. 7 is an enlarged cross sectional view of the lower latch mechanism shown in FIG. 2;

Referring to FIGS. 1 and 2, there is illustrated a gate assembly 2 comprising frame means 4 and barrier means 6. The barrier means 6 is hingedly movable relative to frame means 4 between an open position, wherein passage through an opening of the gate is possible, to a closed position, wherein passage through the opening of the gate is prevented.

The frame means 4 includes two spaced apart lateral frame members 8, 10 and a base frame member 12 joining the lower ends 14, 16 of the lateral frame members together. An opening is defined between frame members 8, 10, 12 to allow passage of a user therethrough when the barrier means is in an open position.

Adjustable positioning means in the form of screw threaded friction pads 20 are provided on upper and lower parts of the lateral frame members 8, 10 to allow engagement of the frame against the walls of a doorway opening in use. The friction pads 20 are rotatable via screw threaded portions 22 joined to pads 20 to allow adjustment of the width of the gate assembly. Screw threaded portions 22 are complementary to screw threaded portions 24 defined on an internal surface of housing 26 to allow movement of the friction pads in a substantially horizontal direction. Other adjustable positioning means could be provided in required.

The barrier means 6 includes a gate panel having a base member 28, a top member 30 and a plurality of upright struts 32 located at spaced apart intervals between members 28, 30.

The barrier means 6 is hingedly joined to lateral frame member 8 via upper hinge 34 and lower hinge 36. In accordance with the present invention, lower hinge 36 includes an automatic closure mechanism as will be described in more detail below. A latch mechanism 38 is provided between end 40 of top member 30 and upper end 42 of lateral frame member 10.

Figure 3:
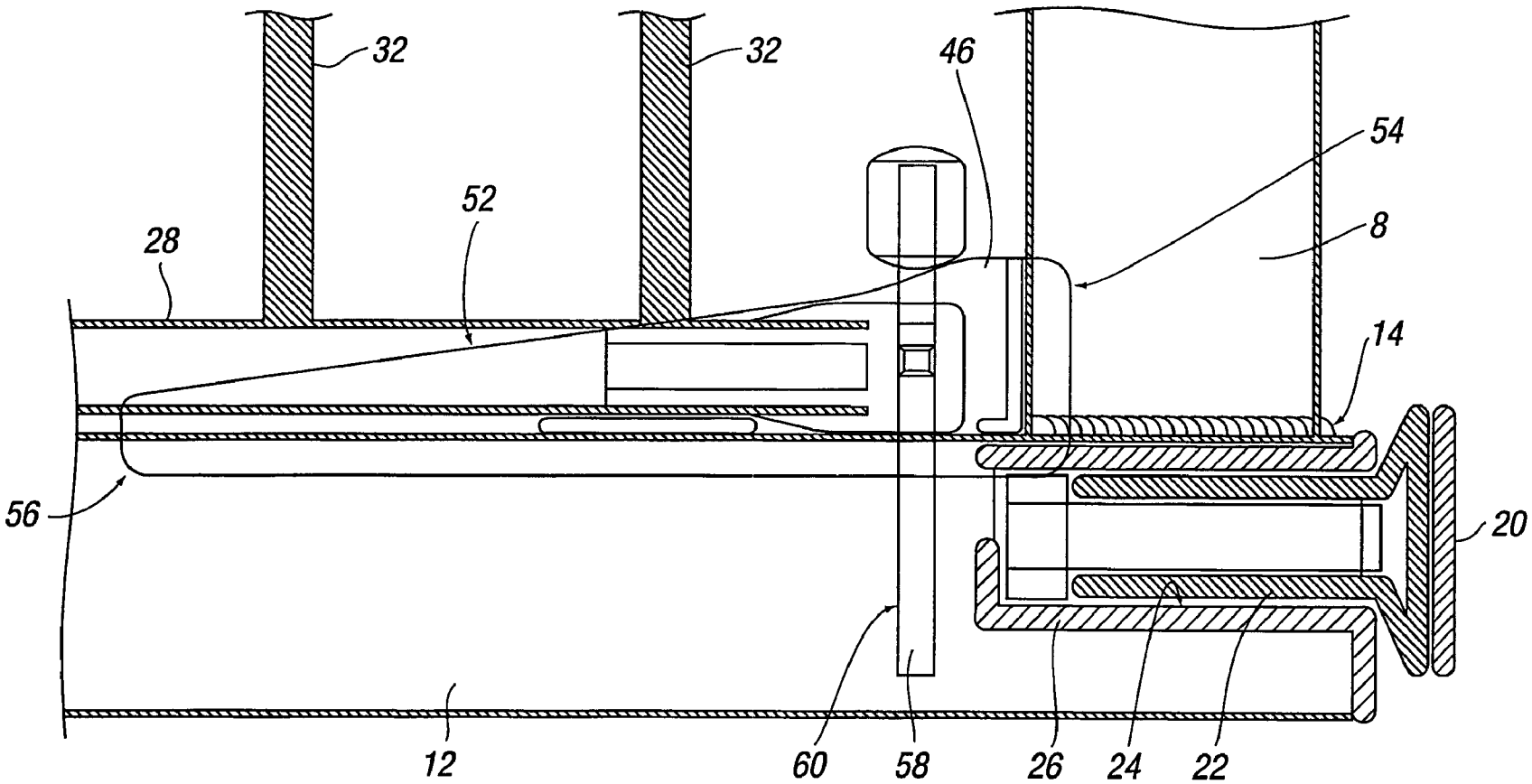
FIG. 3 is an enlarged view of the automatic closure mechanism shown in FIGS. 1 and 2 showing the different components.

The automatic closure mechanism includes a housing 44 having inclined side walls 46, 48 with a recess 50 defined between said side walls, as shown in FIG. 3. The top edge 52 of the side walls 46, 48 act as ramps for movement of a lower surface of base member 28 thereon. More particularly, side walls 46, 48 have a narrowing taper from end 54 adjacent lateral post 8 to end 56 facing lateral post 10. Recess 50 is substantially elongate in form and the longitudinal axis is substantially parallel to base frame member 12.

Lower hinge 36 includes a hinge pin 58 which is joined to base member 28 of the barrier means and is rotatably mounted in a complementary shaped channel 60 defined in base frame member 12.

As the gate moves from an open position to a closed position, hinge pin 58 rotates in channel 60 about a longitudinal axis of said pin 58 and a lower surface of base member 28 moves down one edge of side wall 46, 48 from end 54 to end 56. At a pre-determined point in this movement, base member 28 of the barrier means is aligned and substantially parallel with elongate recess 50, causing base member 28 to drop into recess 50, thereby moving base member 28 towards base frame member 12. This in turn closes barrier means 6 with respect to frame means 4 and moves the latch mechanism into a locked position, as will be described in more detail below.

Upper hinge 34 includes a hinge pin 62 provided in a housing 64 joined to top member 30 of the barrier means 6 which is rotatably mounted in a complementary shaped channel 66 defined in a housing 68 joined to lateral frame member 8, as shown in FIGS. 4*a*-5*b*. Hinge pin 62 rotates substantially about the longitudinal axis of pin 62. With the barrier means in an open position, housing 64 is raised a pre-determined spaced apart distance above housing 66 and a lower end 70 of pin 62 is located adjacent a top end 72 of channel 66. A flange 74 on lower end 70 of pin 62 engages with a shoulder 76 of top end 72 to prevent the hinge pin 62 being lifted completely out of engagement with channel 66 in use. As the barrier means 6 moves to a closed position, lower end 70 of pin 62 moves towards end 78 of housing 68, and a lower edge 80 of housing 64 moves adjacent to and/or into engagement with top edge 82 of housing 68. Edges 80 and 82 typically have complementary inclined edges to provide a neat aesthetic appearance to housings 64, 68.

Resilient biasing means in the form of a spring (not shown) are associated with the hinge pin 62 to bias the hinge 34 to a closed position. Thus, whenever the barrier means is opened, as soon as a user lets go of the barrier means, said barrier means moves to a closed position and the base member of the barrier means follows the ramp 52 of the automatic closure mechanism to shut the barrier means.

The latch mechanism 38 includes a handle portion 84 provided at upper end 40 of the barrier means 6, as shown in FIG. 6. A latch 86 is provided on a free end of handle portion 84 for engagement in a recess 88 defined in a keep housing 90 located at upper end 42 of lateral post 10. Latch 86 is slidably mounted in handle portion 84 between an unlatched position, wherein latch 86 is disengaged from keep housing 90, to a latched position, wherein latch 86 engages in keep housing 90. A spring 92 resiliently biases latch 86 to the latched position. A button 94 provided on a top surface of latch 86 allows latch 86 to be moved by a user to the unlatched position.

Thus, in use, in order to open the barrier means, a user grips handle 84 and slides button 94 of latch 86 away from lateral frame member 10 using their fingers, as shown by arrow 96. Once the latch 86 is in an unlatched position, the user lifts handle 84 using the same hand, as shown by arrows 98, thereby lifting base member 28 out of the recess 52 in the automatic closure mechanism and lifting upper hinge pin 62 relative to channel 66 in a substantially vertical direction. With base member 28 clear of recess 52, the barrier means can be moved to an open position. Once the user releases barrier means 6, the barrier 6 automatically closes due to rotation of the hinge pin in the recess, and when base member drops into recess 52, latch 86 is substantially vertically aligned with keep housing 90 and is lowered substantially simultaneously to a latched position.

Optionally, a lower latch mechanism 100 can be provided at end 16 of lateral frame member 10, as shown in FIG. 7. Lower latch mechanism 100 includes a protruding latch 102 joined to free end 104 of base member 28, which locates in a recess 106 of a housing 108 provided on base frame member 12 when the barrier means 6 is in a closed position. Latch 102 is moved clear of recess 106 on lifting barrier means 6 to move the same to an open position. When the latch 86 is vertically aligned with the opening of keep housing 90, latch 102 is substantially vertically aligned with recess 106. Lowering of latch 86 into engagement with keep housing 90 lowers latch 102 into the opening of recess 106.

It will be appreciated that the gate assembly of the present invention can include any or any combination of the above-mentioned features and/or other known features of gate assemblies. The gate assembly can be of any suitable shape, design and/or dimensions and can be formed from any suitable material or material, such as wood, metal, plastic, fabric and/or the like.

The invention claimed is:

1. A gate assembly comprising:

a frame, said frame comprising a base frame member joining lower ends of two spaced apart lateral frame members, positioned in an opening through which selective entry is permitted;

a barrier mountable on the frame via an upper and lower hinge, wherein the barrier is movable relative to the frame between a closed position and an open position; and an automatic closure mechanism adjacent to the lower hinge that automatically moves the barrier from the open position to the closed position, the automatic closure mechanism is disposed on top of the base frame member's upper surface, said automatic closure mechanism having an inclined surface, on top of which at least part of a base of the barrier rotates and moves vertically up and down when moving between the open and closed position.

2. The gate assembly according to claim 1, wherein the inclined surface has a first end disposed adjacent an upright member of the frame and a second end disposed a spaced distance from the upright frame member, the second end being lower in height than the first end.

3. The gate assembly according to claim 1, wherein the automatic closure mechanism includes a recess into which at least a part of a base of the barrier is arranged to drop into just prior to reaching the closed position.

4. The gate assembly according to claim 3, where in use, the barrier is initially lifted in an upward direction to raise the base of the barrier out of the recess and onto the inclined surface when moving the barrier from the closed position to the open position.

5. The gate assembly according to claim 3, wherein the recess is defined between two inclined surfaces.

6. The gate assembly according to claim 1, wherein a resilient biasing member is associated with at least one of the upper and lower hinges to bias the barrier to a closed position.

7. The gate assembly according to claim 1, wherein the at least one hinge includes a hinge pin, disposed in one of the barrier or frame, which is rotatably mountable in an aperture disposed in the other of the barrier or frame.

8. The gate assembly according to claim 6, wherein the resilient biasing member is associated with a base of the barrier or the lower hinge.

9. The gate assembly according to claim 1, wherein the upper and lower hinges are provided on a first side of the barrier, and a latching member for latching the barrier to the frame is provided on a second side of the barrier means.

10. The gate assembly according to claim 3, wherein when:

a base of the barrier is substantially aligned with the recess in the automatic closure mechanism, the latching member on the barrier is substantially aligned with a keep housing on the frame.

11. The gate assembly according to claim 10, wherein the latching member comprises:

a latch element which is slidably movable relative to a recess defined in the keep housing between:

a latched position, wherein the latch element is resiliently biased to be located in the recess of the keep housing to keep the barrier closed; and an unlatched position, wherein the latch element is located a spaced distance from the recess of the keep housing and the barrier can be opened.

12. The gate assembly according to claim 11, where in use, the latch element is moved in a direction away from the keep housing and is then lifted onto the inclined surface in order to move the barrier from the closed position to the open position.

13. A gate assembly comprising:

a frame, said frame comprising a base frame member joining lower ends of two spaced apart lateral frame members, positioned in an opening through which entry is permitted;

a barrier mounted on the frame via an upper hinge and a lower hinge, wherein the barrier moves relative to the frame between an open position and a closed position; and an automatic closure mechanism adjacent to the lower hinge, that automatically biases the barrier from the open position to the closed position, the automatic closure mechanism having a ramp, disposed on top the base frame member's upper surface, over which a base of the barrier rotates and moves vertically up and down.

14. The gate assembly according to claim 13, wherein the automatic closure mechanism includes a recess into which at least a part of the base of the barrier is dropped into in the closed position.

15. The gate assembly according to claim 14, where in use, the barrier is initially lifted in an upward direction to raise the base of the barrier out of the recess and onto the ramp when moving the barrier from the closed position to the open position.

16. A method of using a gate assembly, the method including:

positioning a frame, said frame comprising a base frame member joining lower ends of two spaced apart lateral frame members, in an opening through which selective entry is permitted;

mounting a barrier on the frame via an upper and lower hinge to permit movement of the frame between an open and closed position;

providing an automatic closure mechanism having a ramp, disposed on top of the base frame member's upper surface, adjacent to the lower hinge; and automatically biasing the barrier from the open position to the closed position, as part of a base of the barrier rotates and moves vertically up and down over the ramp.

17. The method according to claim 16, where in the closed position, at least a part of a base of the barrier is dropped into a recess.

18. The method according to claim 17, further comprises:

lifting the barrier in an upward direction to raise the base of the barrier out of the recess and onto the ramp to enable the barrier to move to the open position.

19. The method according to claim 16, wherein the recess is defined between two inclined surfaces.

* * * * *